US008405684B2

(12) United States Patent
Chou

(10) Patent No.: US 8,405,684 B2
(45) **Date of Patent: *Mar. 26, 2013**

(54) METHOD AND APPARATUS FOR CALIBRATING THE BRIGHTNESS OF THE CARBON NANOTUBE DISPLAY

(75) Inventor: Yen-Ynn Chou, Taipei County (TW)

(73) Assignee: Princeton Technology Corporation, Hsin Tien, Taipei County (TW)

( * ) Notice: Subject to any disclaimer, the term of this patent is extended or adjusted under 35 U.S.C. 154(b) by 727 days.

This patent is subject to a terminal disclaimer.

(21) Appl. No.: 12/565,438

(22) Filed: Sep. 23, 2009

(65) Prior Publication Data

US 2010/0128068 A1 May 27, 2010

(30) Foreign Application Priority Data

Nov. 27, 2008 (TW) ..... 97145901 A

(51) Int. Cl.
*G09G 5/10* (2006.01)

(52) U.S. Cl. ..... 345/690

(58) Field of Classification Search ..... None
See application file for complete search history.

(56) References Cited

U.S. PATENT DOCUMENTS

| | | | | |
|---|---|---|---|---|
| 7,460,095 | B2 * | 12/2008 | Osame et al. | 345/82 |
| 7,592,975 | B2 * | 9/2009 | Yamazaki et al. | 345/60 |
| 2005/0264472 | A1 * | 12/2005 | Rast | 345/30 |

* cited by examiner

*Primary Examiner* — K. Wong
(74) *Attorney, Agent, or Firm* — Muncy, Geissler, Olds & Lowe, PLLC

(57) ABSTRACT

A drive circuit of a carbon nanotube display (CNDP) used to drive at least a pixel of a CNDP is provided, having an output stage and a calibration device. The output stage is coupled to the pixel and controlled by a pixel signal to switch the pixel between a high voltage and a low voltage. The calibration device is coupled between the output stage and the pixel and controlled by a bias to calibrate the equivalent resistance of the calibration device and further calibrate the brightness of the pixel.

10 Claims, 7 Drawing Sheets

METHOD AND APPARATUS FOR CALIBRATING THE BRIGHTNESS OF THE CARBON NANOTUBE DISPLAY

CROSS REFERENCE TO RELATED APPLICATIONS

This Non-provisional application claims priority under 35 U.S.C. §119(a) on Patent Application No(s). 097145901, filed in Taiwan, Republic of China on Nov. 27, 2008, the entire contents of which are hereby incorporated by reference.

BACKGROUND OF THE INVENTION

1. Field of the Invention

The present invention relates to carbon nanotube displays (CNDPs), and in particular relates to an apparatus and method for calibrating the brightness of the CNDPs.

2. Description of the Related Art

A carbon nanotube display (CNDP) is a very popular field-emission display. With high brightness and wide viewing angles as cathode ray tube (CRT) displays and a small size and light weight as liquid crystal displays (LCD), demand for CNDPs is expected to continue to grow in the future.

FIG. 1 is a schematic diagram illustrating the driver circuit of the CNDP. The CNDP 100 comprises a plurality of pixels 102. The output stage 104 of the driver circuit 110 further comprises a p-type MOSFET (PMOS) 112 and an n-type MOSFET (NMOS) 114, and each of the transistors 112 and 114 comprises a gate coupled to a pixel signal $S_p$ and controlled by the pixel signal $S_p$. When the voltage of the pixel signal $S_p$ is low, the PMOS 112 is turned on and the NMOS 114 is turned off. Thus, the voltage of the pixel 102 rises to about the high voltage $V_H$. Contrarily, when the voltage of the pixel signal $S_p$ is high, the PMOS 112 is turned off and the NMOS 114 is turned on. Thus, the voltage of the pixel 102 falls to about the low voltage $V_{GND}$. Therefore, the pixel 102 is driven by the pixel signal $S_p$.

FIG. 2 is a schematic diagram illustrating the transfer characteristic curve of the pixel 102 of the CNDP 100. In the initial stage of using the CNDP 100, the pixel 102 has a transfer characteristic curve 202 as shown in FIG. 2. However, owing to a special basic characteristic of the CNDP, the transfer characteristic curve 202 of the pixel 102 of the CNDP 100 is often shifted, wherein the transfer characteristic curve 204 is increased over time. In the prior art, the pixel 102 is applied by a constant current $I_{const}$ as shown in FIG. 2, and as time goes by, the voltage on the pixel 102 is shifted from voltage $V_1$ to voltage $V_2$. The shifting voltage causes the brightness of the CNDP 100 to accordingly increase, thus making the display quality of the CNDP unstable.

Therefore, an apparatus for calibrating the brightness of a CNDP is desired.

BRIEF SUMMARY OF INVENTION

A driver circuit of a carbon nanotube display (CNDP), used to drive at least a pixel of a CNDP, is provided. The driver circuit comprises an output stage and a calibration device, wherein the output stage is coupled to the pixel and controlled by a pixel signal to switch the pixel between a high voltage and a low voltage. The calibration device, coupled between the output stage and the pixel, is controlled by a bias to calibrate the equivalent resistance of the calibration device and further calibrate the brightness of the pixel.

A method for calibrating the brightness of a carbon nanotube display (CNDP) is provided, comprising disposing a driver circuit on the CNDP. comprising at least an output stage, wherein the output stage is coupled to a pixel and controlled by a pixel signal to switch the pixel between a high voltage and a low voltage, disposing a calibration device between the output stage and the pixel, and applying a bias to the calibration device to calibrate the equivalent resistance of the calibration device and further calibrate the brightness of the pixel.

A detailed description is given in the following embodiments with reference to the accompanying drawings.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 3:
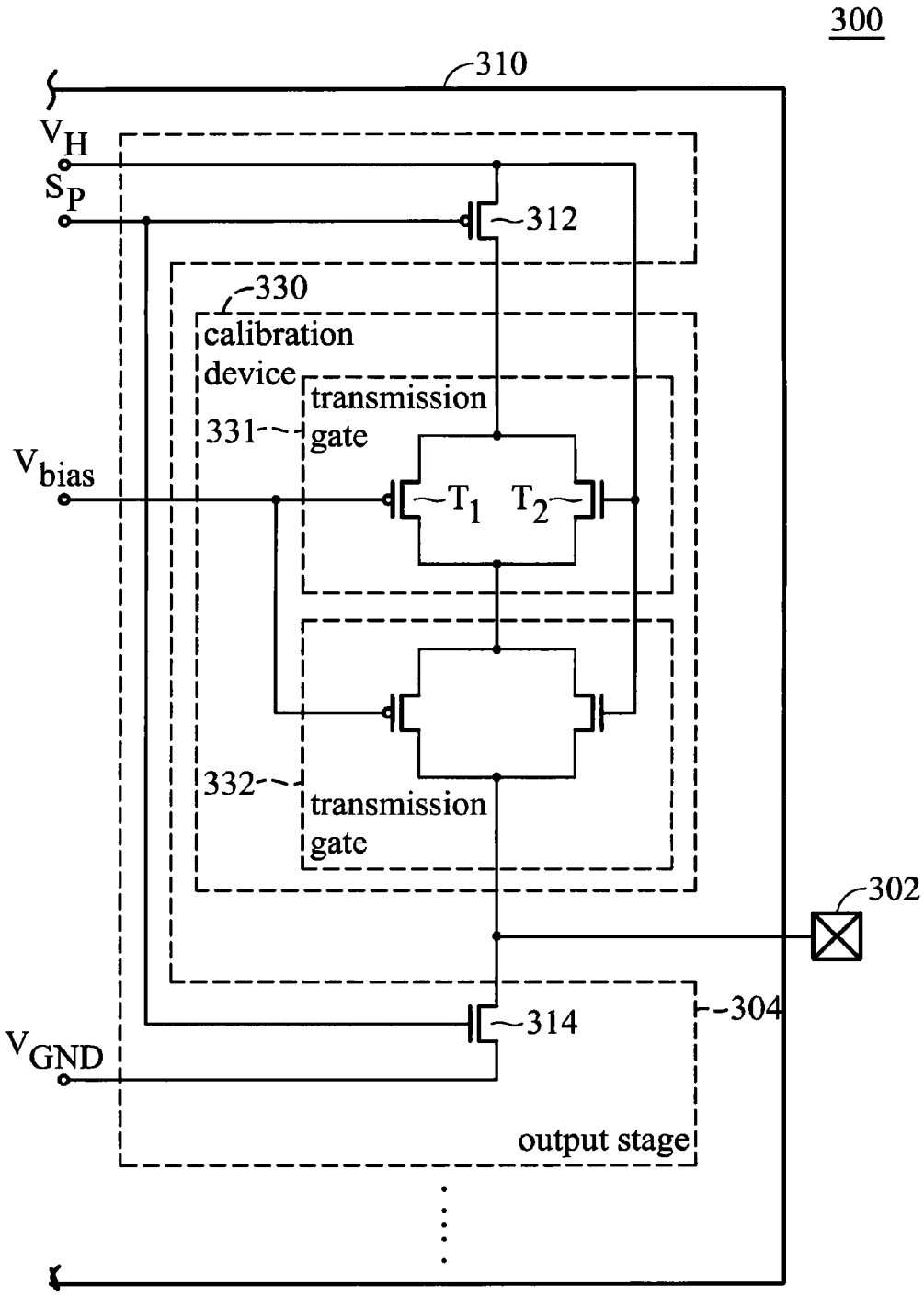
FIG. 3 is a schematic diagram illustrating a driver circuit of the CNDP according to one embodiment of the present invention.

FIG. 3 is a schematic diagram illustrating a driver circuit 310 of the CNDP 300 according to one embodiment of the present invention. In this embodiment, the CNDP 300 comprises the driver circuit 310 and a pixel 302 which is coupled to the driver circuit 310. The driver circuit 310 further comprises an output stage 304 and a calibration device 330. Although there is only one pixel 302 and its corresponding output stage 304 and calibration device 330 shown and described in this embodiment, those skilled in the art will appreciate that the invention is not limited in this regard.

Figure 1:
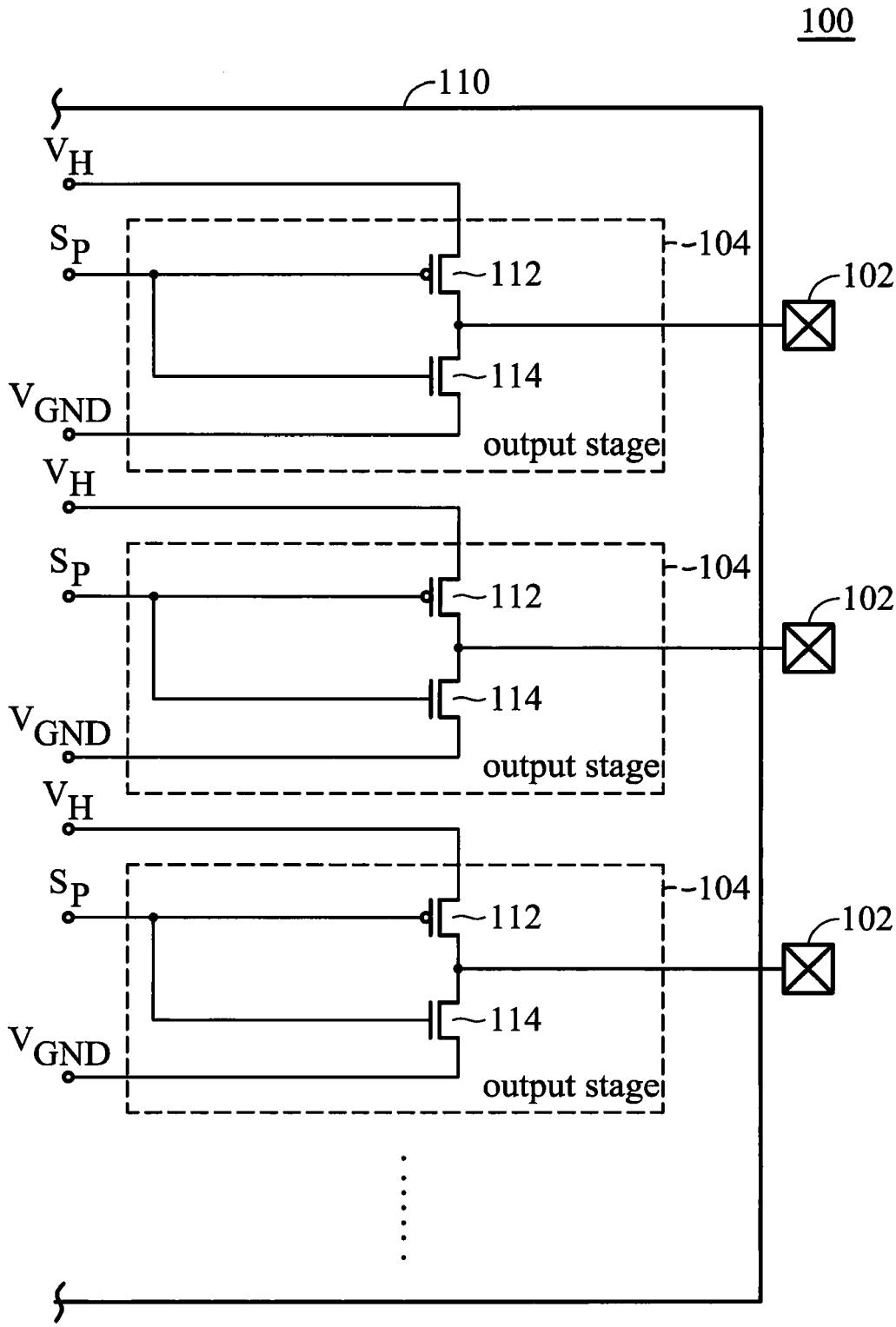
FIG. 1 ( PRIOR ART )
FIG. 1 is a schematic diagram illustrating the driver circuit of the CNDP.
Figure 2:
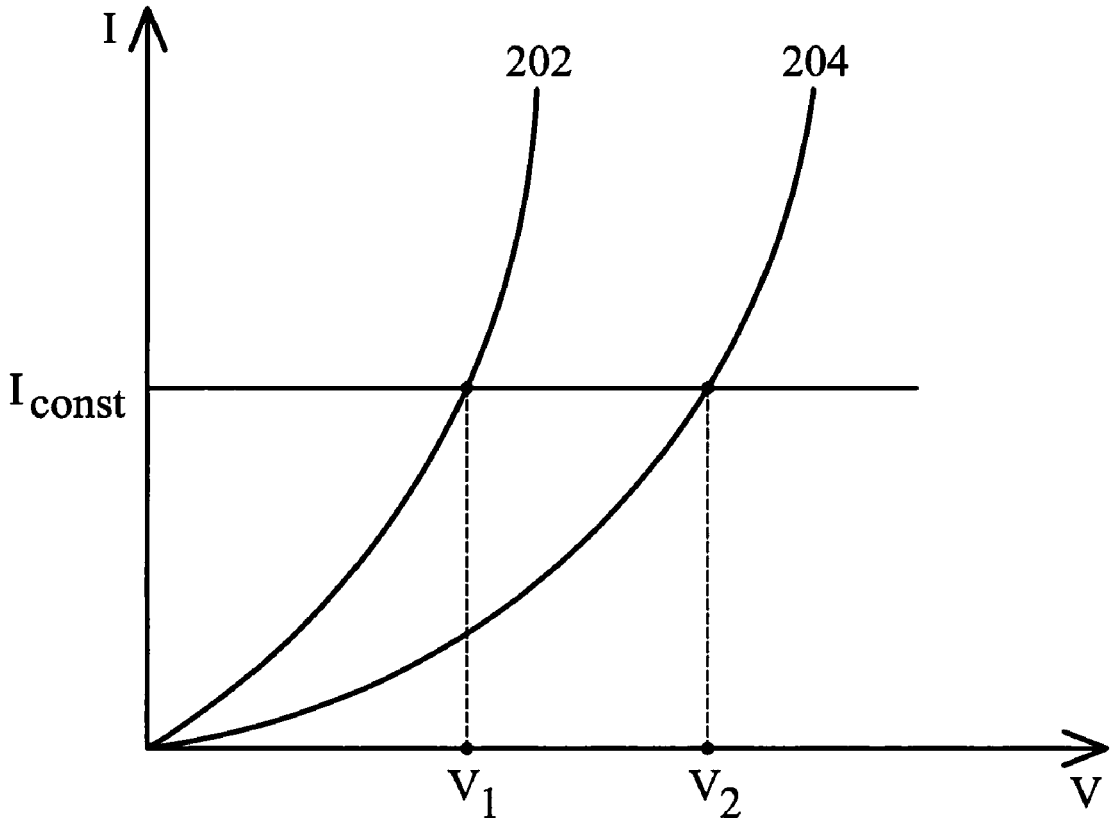
FIG. 2 is a schematic diagram illustrating the transfer characteristic curve of the pixel of the CNDP.
Figure 4:
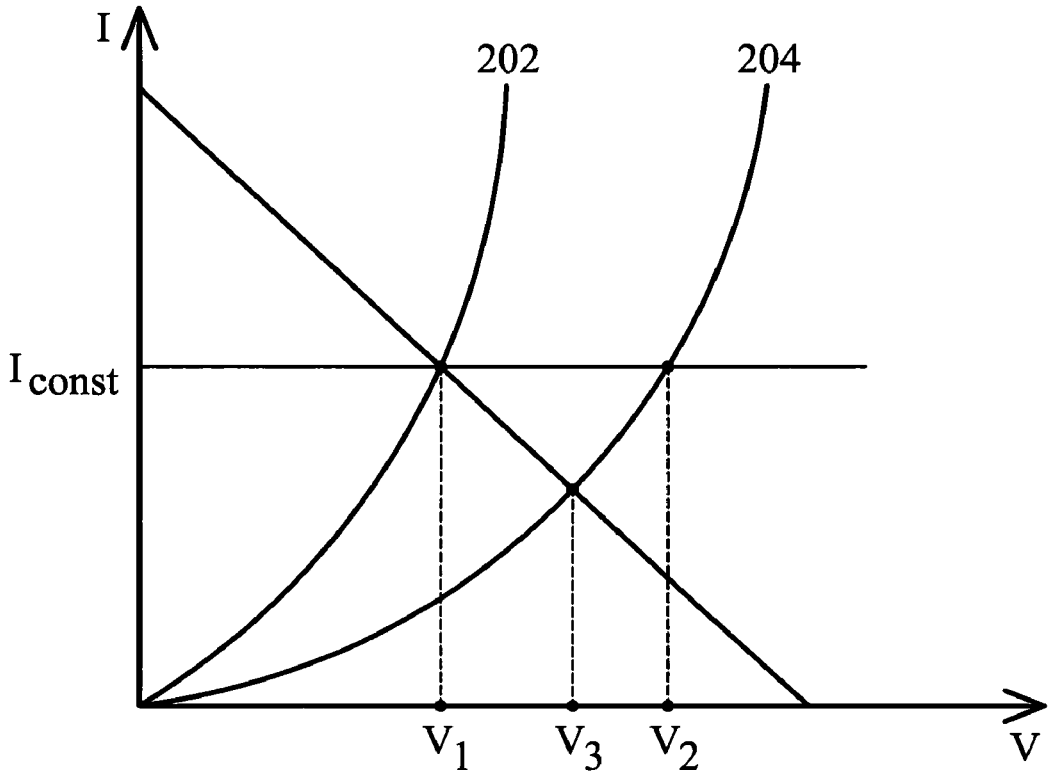
FIG. 4 is a schematic diagram illustrating the transfer characteristic curve of the pixel of the CNDP.

FIG. 4 is a schematic diagram illustrating the transfer characteristic curve of the pixel 302 of the CNDP 300. Referring to FIG. 2, as discussed above, the voltage on the pixel in the prior art may rise from the voltage $V_1$ to the voltage $V_2$ due to the transfer characteristic curve of CNDP and constant current $I_{const}$ applied. A calibration device 330 is additionally disposed in the CNDP 300 in the invention in order to form a variable linear resistor on the output end of the driver circuit 310, and the effect whereof is illustrated by a bias line L in FIG. 4. When the equivalent resistance R of the calibration device 330 is given, the slope of the bias line L is $-1/R$. According to the present invention, when the transfer characteristic curve 202 is shifted to transfer the characteristic curve 204, the voltage on the pixel 302 is shifted from the voltage $V_1$ to the voltage $V_3$. Since the voltage $V_3$ in the present invention is lower than the voltage $V_2$ in the prior art, the brightness of the CNDP 300 is compensated and stable. In addition, the calibration device 330 in the present invention allows the resistance to be adjusted, which is beneficial if users want to adjust the brightness of the CNDP. The process will be explained later in detail.

The driver circuit 310 of the CNDP 300 in the present invention comprises the output stage 304 coupled to the pixel 302, is controlled by a pixel signal $S_p$, and voltage on the pixel 302 is switched between the high voltage $V_H$ and the low voltage $V_{GND}$. Similar with the prior art, the output stage 304 comprises a transistor 312 and a transistor 314, wherein the transistor 312 can be a p-type MOSFET (PMOS), and the transistor 314 can be an n-type MOSFET (NMOS). The principle of the output stage 304 is the same as the output stage 104 in the prior art, and will not be discussed again here. In this embodiment, a calibration device 330 is disposed between the driver circuit 310 and the pixel 302 as shown in FIG. 3, and is controlled by the bias $V_{bias}$ to vary the equivalent resistance R of the calibration device 330 in order to calibrate the pixel 302 brightness. In one embodiment, the calibration device 330 comprises a transmission gate 331. The transmission gate 331 further comprises a PMOS transistor $T_1$ and an NMOS transistor $T_2$, wherein the source of the transistor $T_1$ is coupled to the drain of the transistor $T_2$, the drain of transistor $T_1$ is coupled to the source of transistor $T_2$, the gate of the transistor $T_1$ is coupled to the bias $V_{bias}$, and the gate of the transistor $T_2$ is coupled to the high voltage $V_H$. In another embodiment, the calibration device may comprise two or more than two transmission gates which are connected in series. In this case, the first transmission gate 331 is coupled to the output stage 304 while the last transmission gate 332 is coupled to the pixel 302. Note that the amount of the transmission gates will effect the adjustment for the equivalent resistance of the calibration device 330. Additionally, linearity of the equivalent resistance of the calibration device 330 will also be affected and adjustment may be made by those skilled in the art to the amount of the transmission gates according to requirements.

Figure 5:
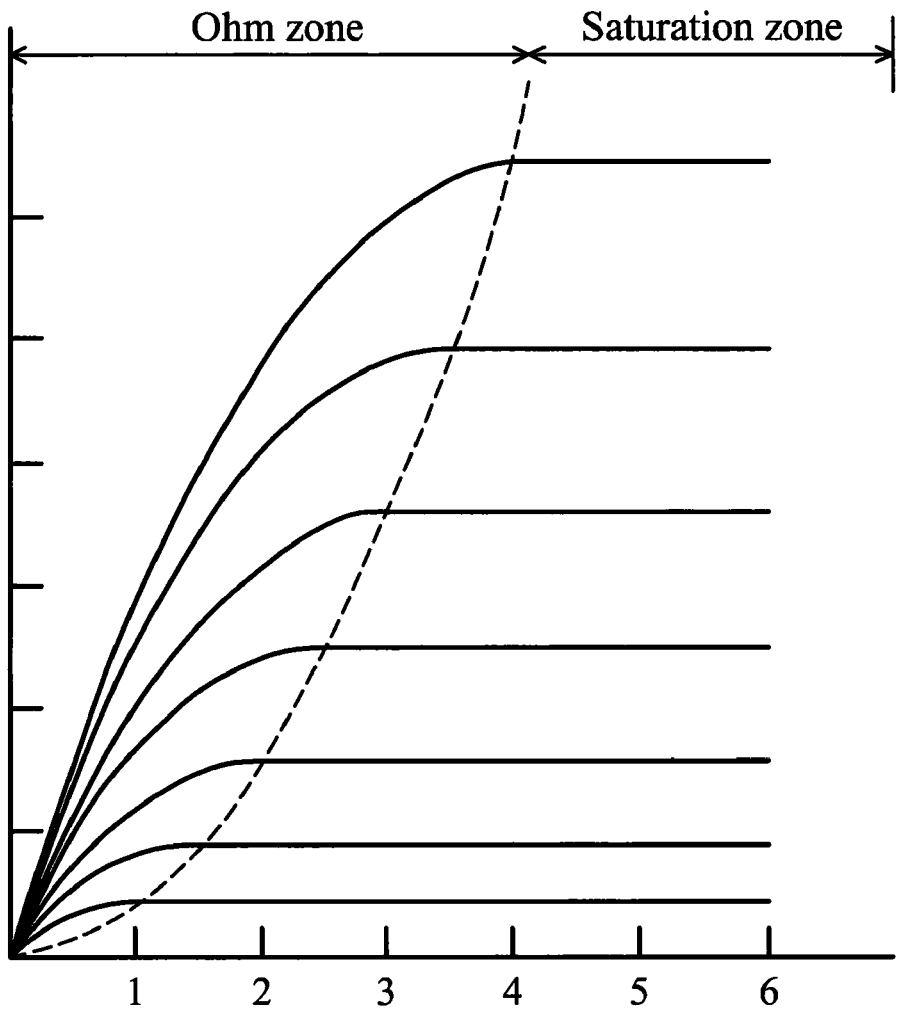
FIG. 5 is a diagram illustrating the output characteristic of a transistor.

For convenience, only one transmission gate 331 is described in the embodiment. When the pixel signal pixel signal S, is high, the brightness of the pixel 302 is about zero and requires no calibration. But when the pixel signal pixel signal $S_p$ is low, the PMOS transistor $T_1$ is turned on and the NMOS transistor $T_2$ is turned off, and the driver circuit 310 outputs the high voltage $V_H$ to the pixel 302, thus the brightness of the 200 is high. As discussed above, because the voltage of the pixel 302 will become brighter as usage time for the CNDP 300 increase, it is necessary to dispose the calibration device 330 on the CNDP to render the brightness normal. FIG. 5 is a diagram illustrating the output characteristic of a transistor describing that the transistor can be operated in a saturation zone or Ohm zone based on different voltage conditions. When the voltages on the gate and drain of the transistor $T_2$ of the calibration device 330 are high at the same time, the transistor $T_2$ will be operated in the saturation zone. In this case, the transistor $T_2$ can be regarded as a non-linear resistor having resistance $R_2$. Otherwise, the transistor $T_1$ in the calibration device 330 can be operated in the Ohm zone (in condition when the source-gate voltage difference $V_{SG}$ is greater than the sum of the source-drain voltage difference $V_{SD}$ and the threshold voltage $V_T$), and those skilled in the art can control the transistor T1 operated in the Ohm zone by controlling the high voltage $V_H$ and the bias $V_{bias}$. When the transistor $T_1$ is operated in the Ohm zone, the transistor $T_1$ is regarded as a linear resistor having resistance $R_1$. The formula for the resistance $R_1$ is as follows (where $V_{SG1}$, the source-gate voltage difference of the transistor $T_1$, is equal to the high voltage $V_H$ minus the bias $V_{bias}$):

$$R_1 = \frac{1}{\mu_p C_0 \left(\frac{W_1}{L_1}\right)(V_{SG1} - V_{T1})}.$$

In the present invention, since the transistor $T_1$ and transistor $T_2$ can be regarded as two resistor $R_1$ and $R_2$ connected in parallel, the equivalent resistance R ($=R_1 \| R_2$) can be easily obtained. Therefore, those skilled in the art can adjust the equivalent resistance R of the calibration device 330 by controlling the bias $V_{bias}$ in order to calibrate the brightness of the CNDP 300.

Figure 6:
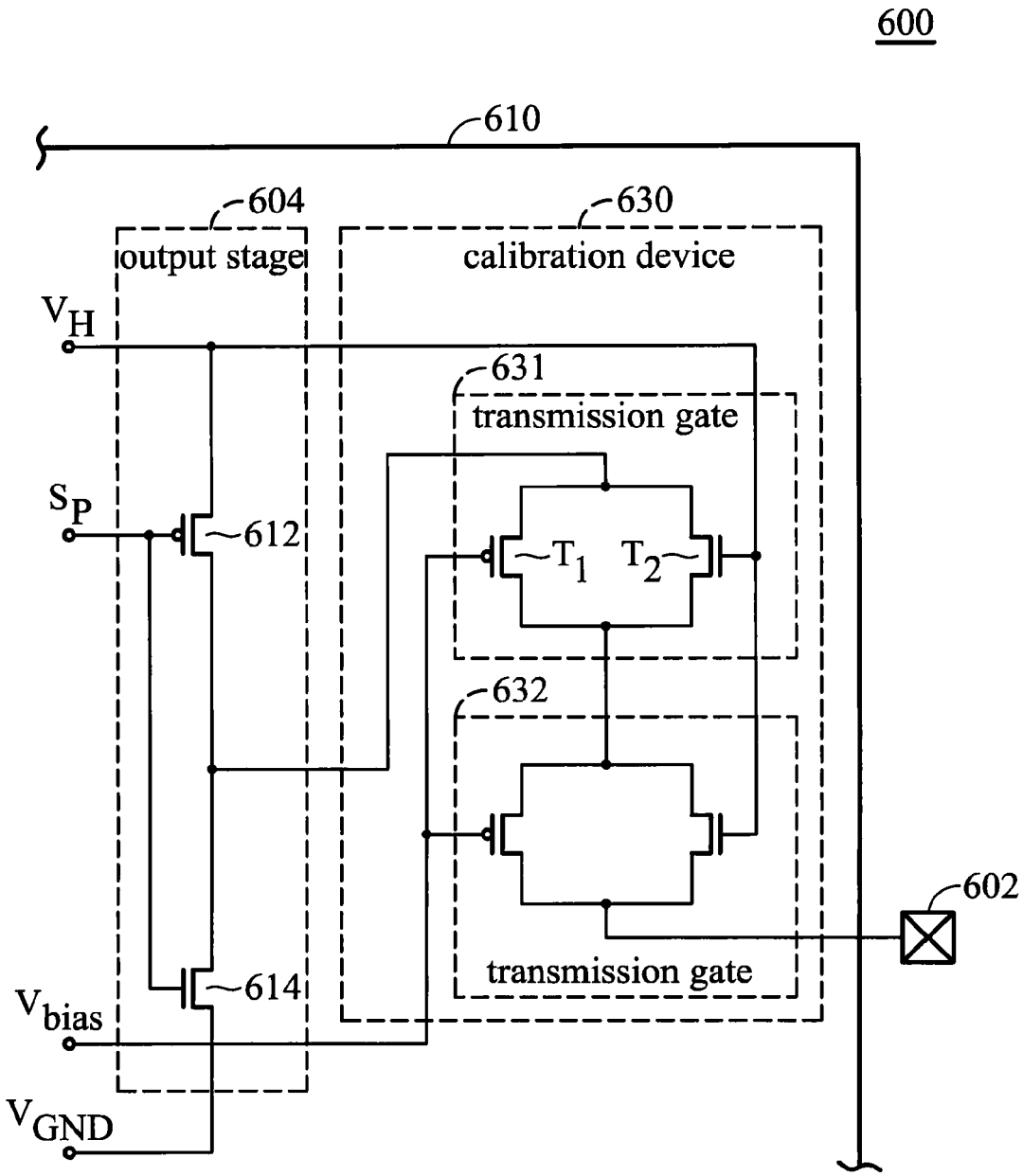
FIG. 6 is a schematic diagram illustrating a driver circuit of the according to another embodiment of the present invention.

FIG. 6 is a schematic diagram illustrating a driver circuit 610 of the 600 according to another embodiment of the present invention. In this embodiment, the 600 comprises the driver circuit 610 and the pixel 602 which is coupled to the driver circuit 610. The driver circuit 610 further comprises the output stage 604 and the calibration device 630. The calibration device 630 is coupled between the output stage 604 and the 602 and has the transmission gates 631 and 632. Similarly, the amount of transmission gates is not limited. Although the connection method of the transmission gates in this embodiment is slightly different from the foregoing embodiment, the calibration device 630 and calibration device 330 can arrive at almost the same effect.

As shown in FIG. 3, the transistor $T_1$ in the calibration device 330 can be a p-type MOSFET, and the transistor $T_2$ can be an n-type MOSFET. Note that the present invention not only improves the brightness problems of the CNDP in the prior art, but also reduces the size of the driver circuit 310 due to the size of the transistor $T_1$ and transistor $T_2$ which are able to be disposed in an integrated circuit.

Figure 7:
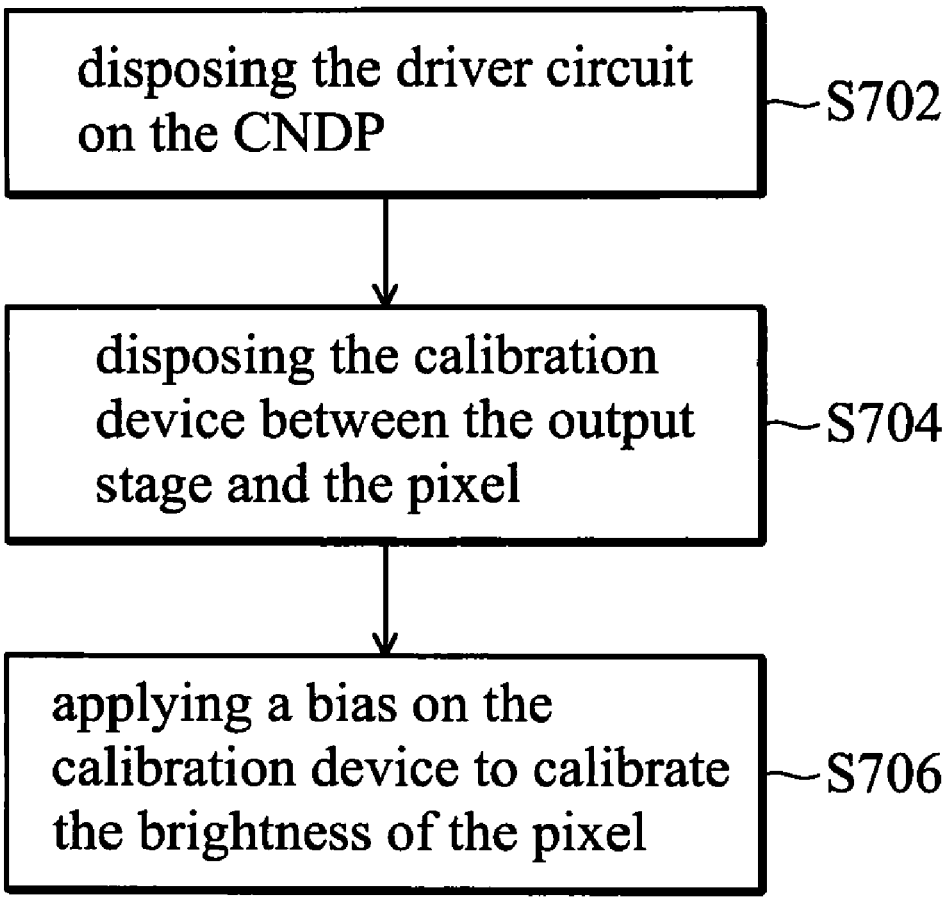
FIG. 7 shows the flow chart of the method for calibrating the brightness of the CNDP.

FIG. 7 shows the flow chart of the method for calibrating the brightness of the CNDP. Referring to FIG. 3, the method comprises disposing the output stage 304 to the CNDP in step S702, wherein the driver circuit 310 comprises at least an output stage 304 which is coupled to the pixel 302 of the CNDP 300 and is controlled by a pixel signal pixel signal $S_p$, to switch between the high voltage $V_H$ and the low voltage $V_{GND}$. In step S704, the calibration device 330 is disposed between the output stage 304 and the pixel 302, and in step S706, a bias on the calibration device 330 is applied to adjust the equivalent resistance R of the calibration device 330 in order to calibrate the brightness of the pixel 302.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A driver circuit of a carbon nanotube display (CNDP) for at least a pixel of a CNDP, comprising:

an output stage coupled to the pixel and controlled by a pixel signal to switch the pixel between a high voltage and a low voltage; and a calibration device coupled between the output stage and the pixel and controlled by a bias to calibrate the equivalent resistance of the calibration device for calibrating the brightness of the pixel.

2. The driver circuit of a CNDP as claimed in claim 1, wherein the calibration device comprises a plurality of transmission gates in series, wherein a first transmission gate is coupled to the output gate and the last transmission gate in the transmission gates is coupled to the pixel.

3. The driver circuit of a CNDP as claimed in claim 2, wherein each of the transmission gates comprises a first transistor and a second transistor, wherein a source of the first transistor is coupled to a drain of the second transistor, a drain of the first transistor is coupled to a source of the second transistor, and a gate of the first transistor is coupled to the bias; and a gate of the second transistor is coupled to the high voltage.

4. The driver circuit of a CNDP as claimed in claim 3, wherein the first transistor is a p-type MOSFET, and the second transistor is an n-type MOSFET.

5. The driver circuit of a CNDP as claimed in claim 1, wherein the output stage comprises a p-type MOSFET and an n-type MOSFET, and gates of the p-type and n-type MOSFETs are all coupled to the pixel signal.

6. A method for calibrating the brightness of a carbon nanotube display (CNDP), comprising:

disposing a driver circuit on the CNDP with at least an output stage, wherein the output stage is coupled to at least one pixel in the CNDP and controlled by a pixel signal to switch the pixel between a high voltage and a low voltage;

disposing a calibration device between the output stage and the pixel; and applying a bias to the calibration device to adjust the equivalent resistance of the calibration device for calibrating the brightness of the pixel.

7. The method for calibrating the brightness of a CNDP as claimed in claim 6 further comprising disposing a plurality of transmission gates in series in the calibration device, wherein a first transmission gate is coupled to the output stage and the last transmission gate is coupled to the pixel.

8. The method for calibrating the brightness of a CNDP as claimed in claim 6 further comprising disposing a first transistor and a second transistor in each of the transmission gates, wherein a source of the first transistor is coupled to a drain of the second transistor, a drain of the first transistor is coupled to a source of the second transistor, a gate of the first transistor is coupled to the bias, and a gate of the second transistor is coupled to the high voltage.

9. The method for calibrating the brightness of a CNDP as claimed in claim 8, wherein the first transistor is a p-type MOSFET, and the second transistor is an n-type MOSFET.

10. The method for calibrating the brightness of a CNDP as claimed in claim 6, wherein the output stage comprises a p-type MOSFET and an n-type MOSFET, and gates of the p-type and n-type MOSFETs are all coupled to the pixel signal.

* * * * *